US005346447A

United States Patent [19]

Stearns

[11] Patent Number: 5,346,447

[45] Date of Patent: Sep. 13, 1994

[54] EXERCISE MACHINE

[75] Inventor: Kenneth W. Stearns, Houston, Tex.

[73] Assignee: Stearns Technologies, Inc., Houston, Tex.

[21] Appl. No.: 77,320

[22] Filed: Jun. 14, 1993

Related U.S. Application Data

[63] Continuation of Ser. No. 793,857, Nov. 18, 1991, abandoned.

[51] Int. Cl.[5] ..... A63B 21/068

[52] U.S. Cl. ..... 482/96; 482/93; 482/95; 482/142

[58] Field of Search ..... 482/93, 94, 95, 96, 482/142

[56] References Cited

U.S. PATENT DOCUMENTS

| | | | |
|---|---|---|---|
| 248,121 | 10/1881 | Tuttle . | |
| 3,446,503 | 5/1969 | Lawton . | |
| 3,716,230 | 2/1973 | Mark | 482/142 |
| 3,976,058 | 8/1976 | Tidwell | 482/142 |
| 4,489,936 | 12/1984 | Dal Monte . | |
| 4,632,390 | 12/1986 | Richey | 482/142 |
| 4,750,741 | 6/1988 | Smolanovich | 482/142 |
| 4,815,732 | 3/1989 | Mahvi | 482/142 |
| 4,949,958 | 8/1990 | Richey . | |

FOREIGN PATENT DOCUMENTS 2110548A 6/1983 United Kingdom .

*Primary Examiner*—Richard J. Apley
*Assistant Examiner*—Lynne A. Reichard
*Attorney, Agent, or Firm*—Bush, Moseley & Riddle

[57] ABSTRACT

An exercise machine is provided having a platform on which a user is supported in a reclining position with the weight of the user being utilized as a resistance which may be selectively varied to the various exercises which may be performed on the exercise apparatus. A lever is pivotally connected to the platform with the lever being actuated by the user for raising one end of the platform with respect to a pivot point with resistance to such raising being varied by the pivotal mounting of the lever on the platform. Two of the various embodiments include a base support having a rail on which a lever has a roller mounted for riding movement thereon and pivotally connected to a lower leg for pivotal movement. Other embodiments include a lever having telescoping members with an inner one of such telescoping member being selectively fixed to a rail. Such inner telescoping member reciprocates within an outer telescoping member as the platform is raised and lowered.

25 Claims, 7 Drawing Sheets

EXERCISE MACHINE

This application is a continuation of application Ser. No. 793,857 filed Nov. 18, 1991, now abandoned.

BACKGROUND OF THE INVENTION

1. Field of Invention

This invention relates to a variable resistance exercise machine and more particularly to an exercise machine having a platform to support a user in a reclining position with resistance to the exercise provided by the weight of the user.

2. Description of Prior Art

As indicated in U.S. Pat. No. 4,489,936 dated Dec. 25, 1984, a relative inexpensive and simple exercise board or machine has been utilized heretofore which is adapted particularly for home use. As shown in this patent, a platform or board is provided to support a user in a reclining position with the weight of the user providing resistance to the exercises. A movable frame having a single nonadjustable pivot axis is actuated by the user and may be positioned at selected fulcrum points along the platform to provide the desired resistance. Such an exercise machine is relatively inexpensive and can be utilized for exercising various body muscles.

SUMMARY OF INVENTION

The present invention is directed to an exercise machine in which a platform is utilized to support a user in a reclining or supine position with the weight of the user providing resistance to the exercises, the level of which may be adjusted with the machine. A lever is pivoted to one end of the platform and a plurality of spaced pivot axes on the lever permits the selection of a predetermined fulcrum point for the lever. Upon pivoting of the upper extending end of the lever by the user, the adjacent end of the platform is raised along with the body of the user. By varying the pivot axis or fulcrum point, the resistance is likewise varied thereby to permit the machine to be used with users of various strengths.

In one embodiment of the invention a seat supporting the lower torso of the user is pivotally mounted on the platform for relative pivotal movement upon pivoting of the lever for raising the lower body of the user supported on the seat and exercising pelvic muscles. Another embodiment provides a lower rail on which the lower end of the lever is supported for movement therealong upon pivoting of the lever by the user. Such an arrangement facilitates the movement of the lower end of the lever, which might be difficult, if supported on a thick plush carpet for example.

It is an object of this invention to provide an exercise device to support a user in a reclining position and with the resistance to the exercises provided by the weight of the user supported on a platform of the exercise device.

An additional object of this invention is to provide such an exercise machine which is adapted particularly for home use and may be easily folded and stored under a bed or the like.

Another object is to provide such an exercise machine in which the resistance may be easily varied for users of different strengths.

Other objects, features, and advantages of this invention will become more apparent after referring to the following specification and drawing.

DESCRIPTION OF THE INVENTION

Figure 1:
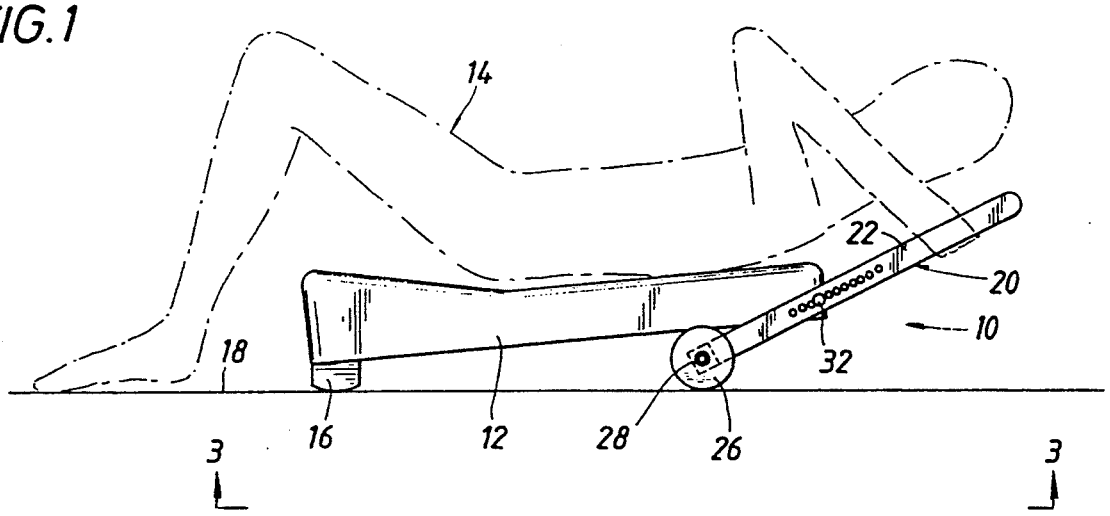
FIG. 1 is a side elevation of one embodiment of the exercise machine comprising the present invention in which a user is in a reclining position on a platform of the machine and the weight of the user provides resistance against pivoting of a variable position lever for raising of the platform.

Ten different embodiments of exercise machines of the present invention are illustrated in the drawings with separate embodiments shown in FIGS. 1–3, FIGS. 46, FIGS. 7–9, FIG. 10, FIG. 11, FIG. 12, FIGS. 13 and 14, and FIGS. 15, 16, 17 and 18. The variable resistance provided for the exercise machine in all of these embodiments is provided by the weight of the user supported in a reclining position on a body supporting platform of each of the embodiments and a lever pivotally connected to an end of the platform. The exercise machines are actuated by one of the following actions:

(1) by the user manually gripping a bar or hand grip adjacent one end of the exercise machine and exerting a pulling force;

(2) by the user exerting a lifting action by his thigh or upper leg against a pad over the platform; or (3) by the user exerting a combination of actions (1) and (2) above.

An exercise machine in accordance with the above by utilizing the weight of the user as a variable resistance is relatively simple and inexpensive. Various muscles or muscle groups may be exercised by the present invention including upper and lower abdominal muscles, pelvic muscles, and specific arm and leg muscles.

Figure 2:
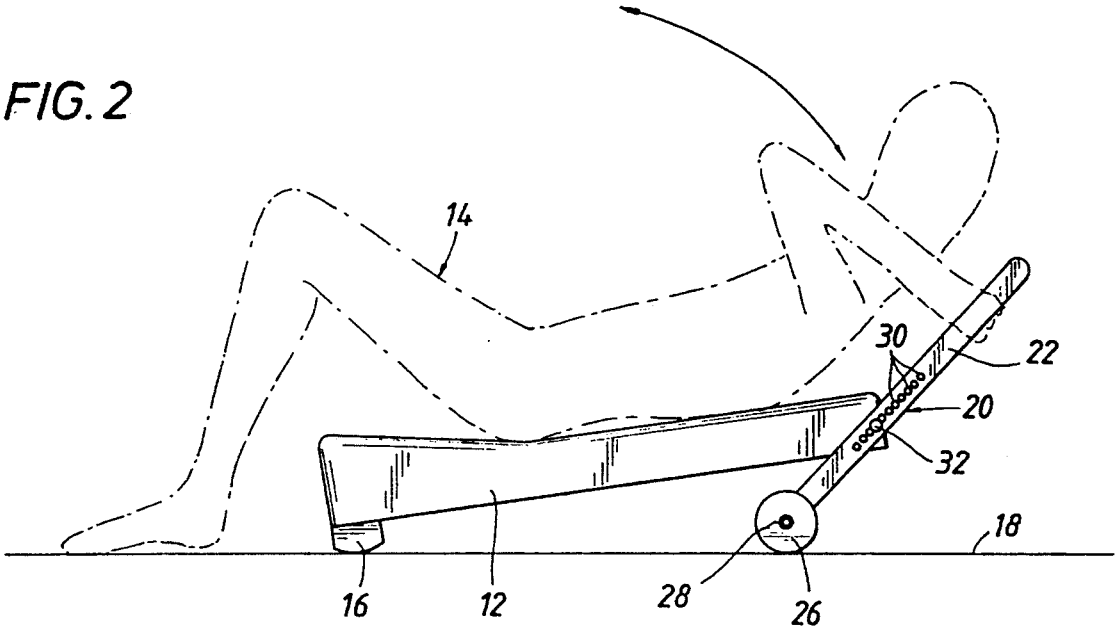
FIG. 2 is a side elevation of the exercise machine of FIG. 1 and shows an end of the platform raised by the user exerting a pulling force on the lever.
Figure 3:
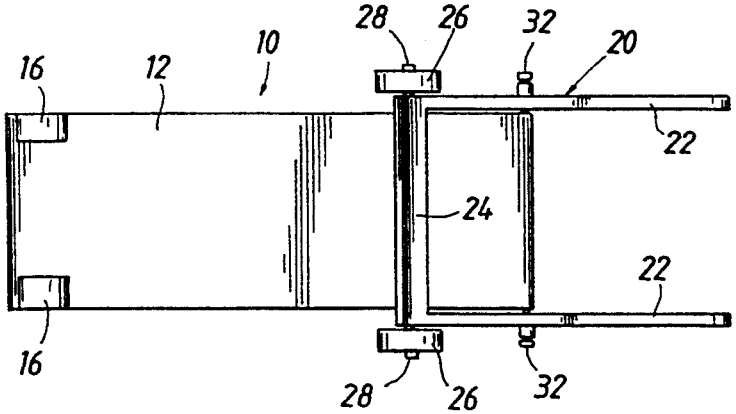
FIG. 3 is a bottom view of the exercise machine shown in FIGS. 1 and 2 taken generally along line 3—3 of FIG. 1.

Embodiment of FIGS. 1–3

Referring first to the embodiment shown in FIGS. 1–3, an exercise machine is shown generally at 10 having a platform 12 to support a user 14 shown in broken lines in a supine position with the weight of user 14 being applied downwardly against platform 12. Platform 12 includes legs 16 supported on a supporting surface 18 such as a floor or carpet on the floor. A lever shown generally at 20 has a pair of parallel arms 22 connected by a lower horizontal base or bar 24 on which rollers 26 are mounted for rotation on axles 28. A plurality of spaced openings 30 are spaced along the length of each lever arm 22 and a spring loaded plunger pin 32 is received within a selected opening 30 and an aligned opening in platform 12 to mount lever 20 for pivotal movement about a pivot axis. The exercise machine 10 is shown in a rest position in FIG. 1 and is shown in a raised actuated position in FIG. 2.

In operation, user 14 grips lever arms 22 manually and pulls upwardly to pivot lever 20 about the pivot axis formed by plunger pins 32 thereby to raise the associated end of platform 12 to the position shown in FIG. 2 with the resistance to such movement provided by the body weight of user 14 on platform 12. Such exercise is known as "crunching" for the exercise of upper abdominal muscles. It is apparent that lengthening the distance between rollers 26 and plunger pins 32 increases the force required by user 14 to pivot lever 20. Such distance may be increased or decreased selectively.

From the foregoing, a relatively simple exercise machine 10 has been provided particularly for home use for easily storing under a bed or the like. The exercise is performed with a selectively variable resistance provided from the weight of the user 14 during the entire movement of lever 20 to an uppermost position and during return of lever 20 to a rest position as shown in FIG. 1.

Figure 4:
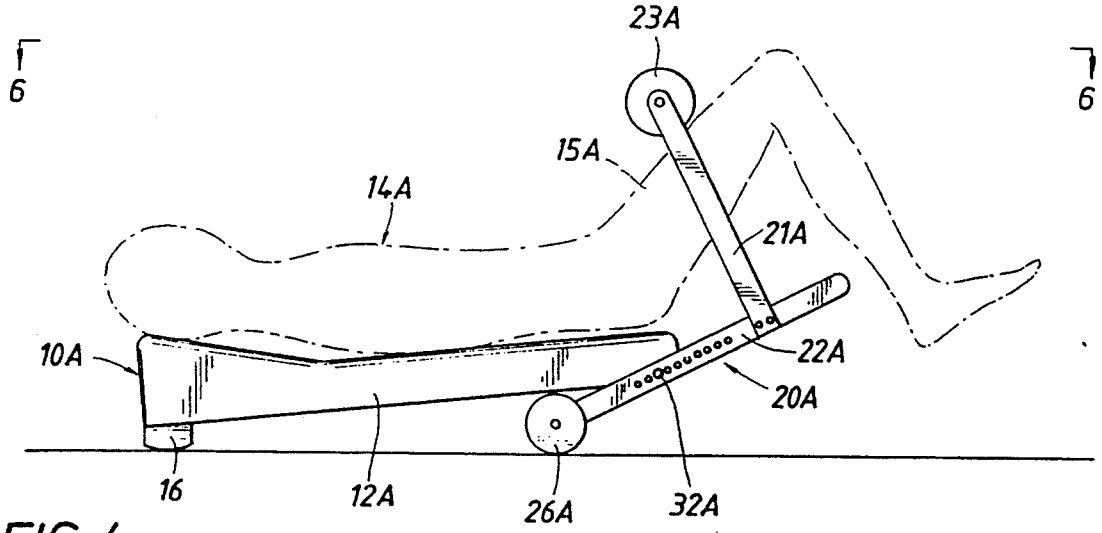
FIG. 4 is a side elevation of another embodiment of an exercise machine in accordance with the present invention in which the thigh or upper leg of the user is utilized for exerting a force on the lever for raising an end of the platform supporting the user in a reclining position.
Figure 5:
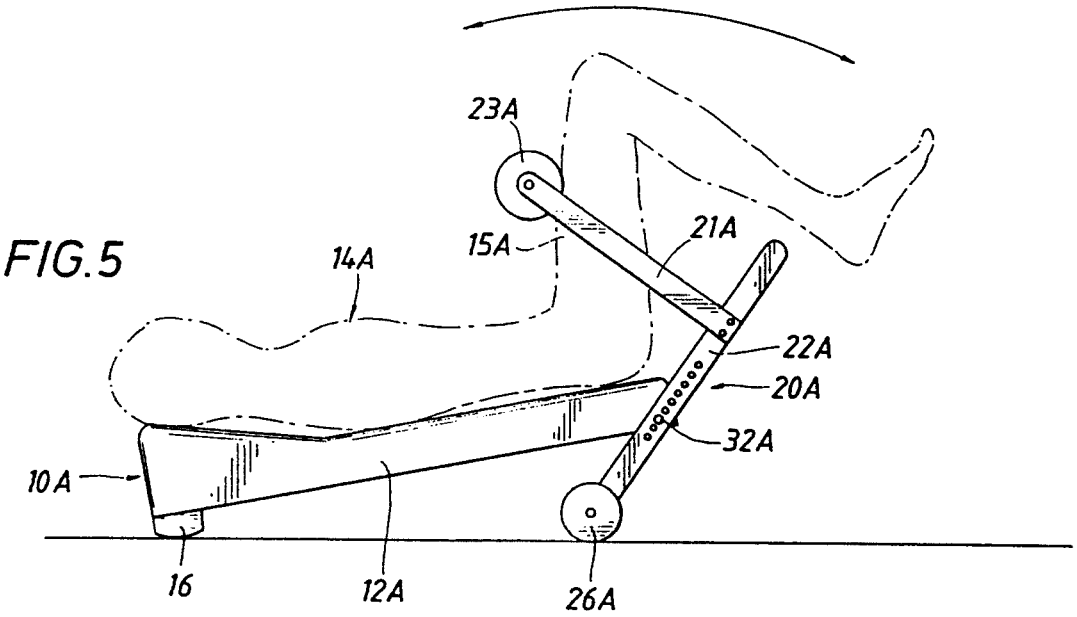
FIG. 5 is a side elevation of the exercise machine of FIG. 4 showing the lever actuated by the thighs of the user thereby pivoting the lever to a position which raises the end of the platform.
Figure 6:
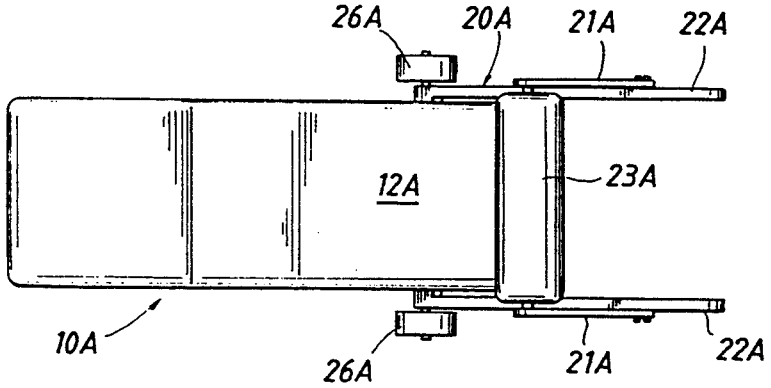
FIG. 6 is a top view of the exercise machine of FIGS. 4 and 5 looking generally along line 6—6 of FIG. 4.

Embodiment of FIGS. 4–6

Referring now to the embodiment shown in FIGS. 4–6, exercise machine 10A is shown having a lever 20A including a pair of lever arms 22A selectively mounted for pivotal movement on an end of platform 12A in a manner similar to the embodiment of FIGS. 1–3. A pair of upper support arms 21A are secured to lever arms 22A and extend upwardly therefrom. An upper leg pad 23A is mounted for rotation on the upper ends of support arms 21A. Such pad is adapted for contact by the upper legs or thighs 15A of user 14A. In operation, a lifting force, applied by thighs 15A against leg pad 23A, pivots lever 20A to the position shown in FIG. 5 with the movement being resisted by the weight of user 14A on platform 12A. As lever arms 22A pivot about pins 32A, rollers 26A roll a small distance as the entire machine pivots about legs 16. Thus, the actuating force in the embodiment of FIGS. 4–6 is applied by thigh 15A of user 14A for the exercising of the lower abdominal muscles.

Figure 7:
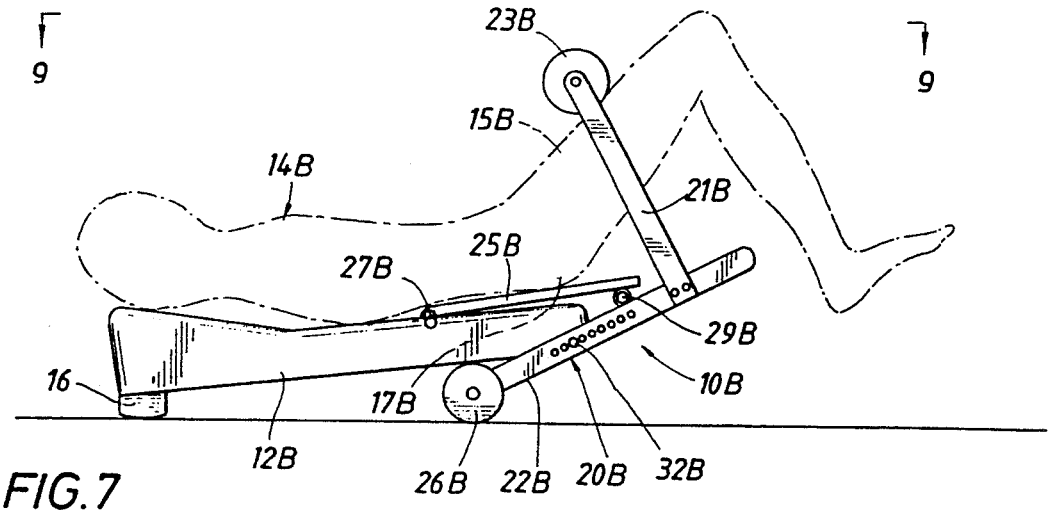
FIG. 7 is a side elevation of a further embodiment of this invention in which a seat is pivotally mounted on the platform for supporting the buttocks or lower torso of a user with the lever and seat being pivoted upon an upper movement of the lever from a force exerted by the thighs of the user.
Figure 8:
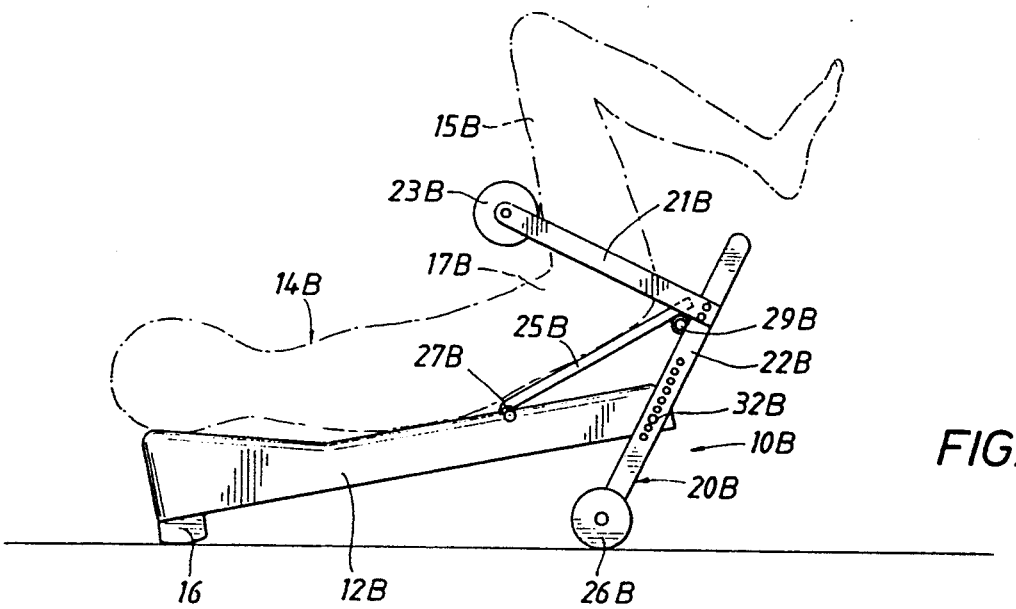
FIG. 8 is a side elevation of the exercise machine of FIG. 7 showing the lever and seat pivoted to an upper position by the thigh of a user supported in a supine position on the platform.
Figure 9:
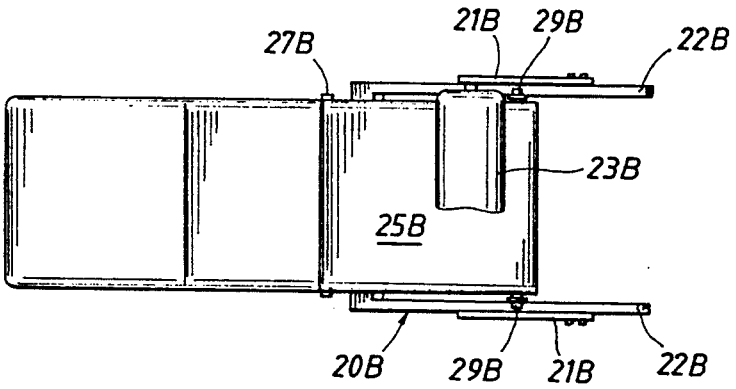
FIG. 9 is a top plan of the exercise machine of FIGS. 7 and 8 taken generally along line 9—9 of FIG. 7.

Embodiment of FIGS. 7–9

Referring now to FIGS. 7–9, an additional embodiment of the exercise machine of the present invention is illustrated at 10B and includes a platform 12B having a lever 20B selectively pivotally mounted at 32B to platform 12B. A leg pad 23B is mounted on lever 20B as in the embodiment of FIGS. 4–6. In addition, a seat 25B has one end pivotally mounted at 27B to platform 12B and has rollers 29B adjacent another end mounted on lever arms 22B for rolling movement thereon. The buttocks or lower torso 17B of user 14B is supported on seat 25B for exercising the pelvic muscles upon rotation thereof as shown in FIG. 8. In operation from the rest position of FIG. 7, upward movement of thighs 15B against leg pad 23B raises lever 20B to the position of FIG. 8 with seat 25B being raised by rollers 29B riding along lever arms 22B thereby to move the lower torso 17B to the position of FIG. 8 for exercising the pelvic muscles. As lever arms 22B pivot about pins 32B, rollers 26B roll a small distance as the entire machine pivots about legs 16.

Figure 10:
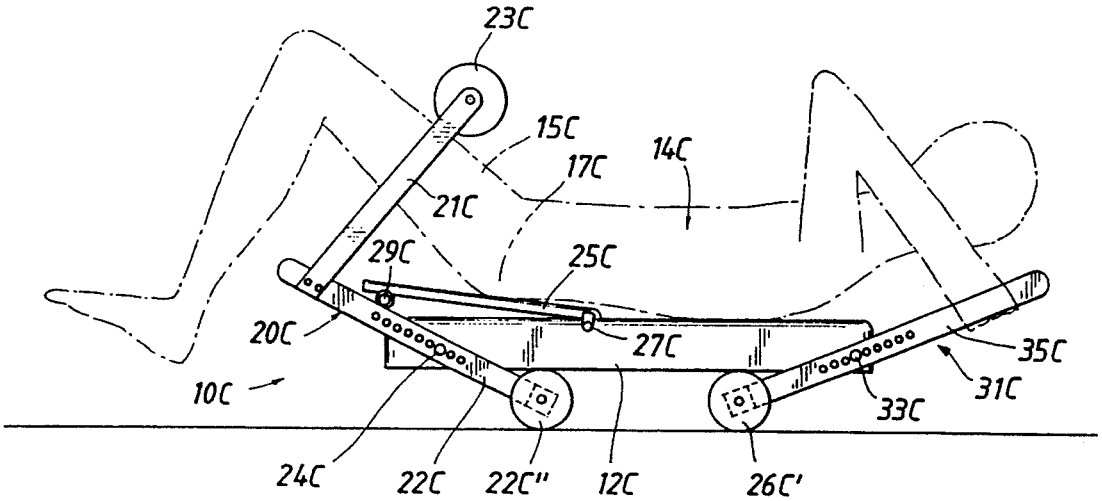
FIG. 10 is a side elevation of a further embodiment of the exercise machine of this invention showing a pair of levers mounted on opposed ends of the platform supporting the user with a seat beneath the lower torso of the user with the exercise machine actuated by a manual pulling force on one lever and a lifting force by the thigh of a user on the other lever.

Embodiment of FIG. 10

Referring now to FIG. 10, a further embodiment of the invention shows an exercise machine 10C having a platform 12C with the lower torso 17C of user 14C supported on a seat 25C pivotally mounted at 27C to platform 12C with rollers 29C configured to roll on lever arms 22C of lever 20C. A roller pad 23C is mounted for rotative movement on the upper ends of support arms 21C. Support arms 21 are secured to lever arms 20C which are selectively mounted to platform 12C for pivot rotation about pins 24C.

In addition, a second lever 31C is selectively pivotally mounted at 33C to platform 12C on the end thereof opposite lever 20C. Lever 31C includes lever arms 35C which are adapted to be gripped by user 14C as shown in broken lines in FIG. 10. In operation, user 14C pulls upwardly on arms 35C to pivot lever 31C about pins 33C upwardly while lifting thighs 15C upwardly against pad 23C to pivot lower lever 20C about pins 24C along with seat 25C as it pivots about pins 27C. Such operation exercises upper and lower abdominal muscles as well as the pelvic muscles. As in other embodiments described above, as lever arm 31C pivots about pins 33C, rollers 26C' roll a small distance, and as lever arms 22C pivot about pins 24C, rollers 26C'' roll a small distance.

Figure 11:
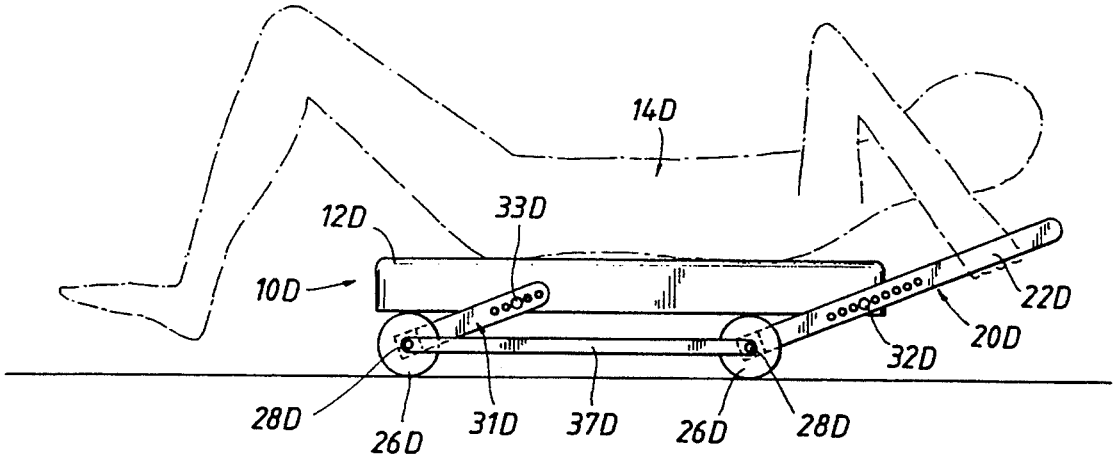
FIG. 11 is another embodiment of the exercise machine in which a four-bar linkage is utilized with the user of the machine gripping and pivoting one of the levers.

Embodiment of FIG. 11

A still further embodiment is shown FIG. 11 in which a four-bar linkage is provided to support platform 12D of exercise apparatus 10D. The four-bar linkage includes levers 20D and 31 D mounted respectively for pivotal movement about pivots or pins 32D and 33D. Pins 32D and 33D may be mounted in various holes provided in lever arms 20D and 31D so as to selectively vary the amount of force exerted on the end of lever arms 20D and 31D to lift platform 12D vertically with the weight of user 14D pressing downwardly. A link 37D is pivotally connected at its ends to pivots 28D on rollers 26D.

A user 14D actuates exercise machine 10D by gripping lever arms 22D to raise levers 20D and 31D for lifting platform 12D against the variable resistance (depending on position of pins 32D and 33D) provided by the weight of user 14D.

Figure 12:
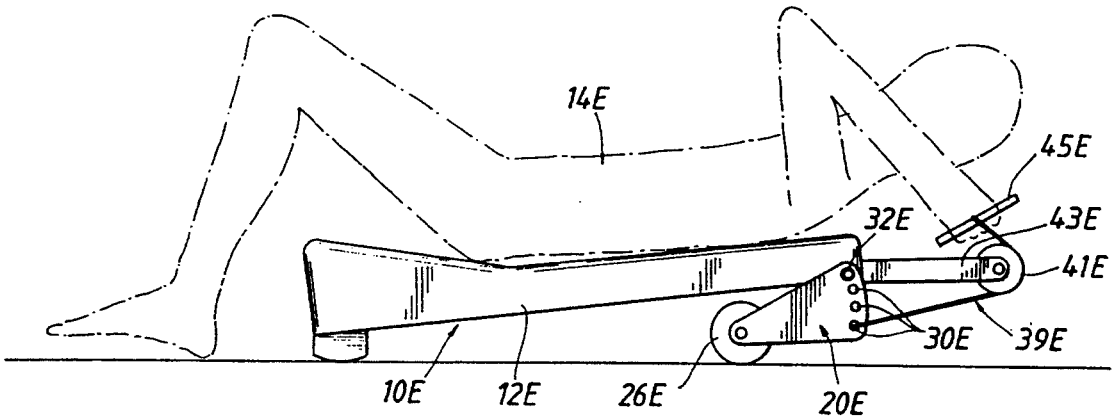
FIG. 12 is a further modification of the exercise machine in which the lever is actuated by a cable pulled by the user in supine position on the platform.

Embodiment of FIG. 12

Referring to FIG. 12, another embodiment of the invention is shown in which a lever 20E is mounted at 32E on each side of platform 12E for pivotal movement relative to platform 12E of exercise apparatus 10E. A roller 26E is mounted on lever 20E for rolling support on a supporting surface such as a floor. A plurality of spaced openings 30E in lever 20E are offset laterally from pivot 32E for selectively varying the anchoring position of the end of a cable shown generally at 39E. Pulleys 41E are mounted for rotation on support arms 43E secured to platform 12E and cables 39E extend about pulleys 41E. A handle 45E on a free end of each cable 39E may be gripped by user 14E for actuation of exercise machine 10E. Upon a pulling force exerted by user 14E on handles 45E, levers 20E pivot about pivots 32E to raise the adjacent end of platform 12E while lever E rolls a small distance on rollers 26E.

Figure 13:
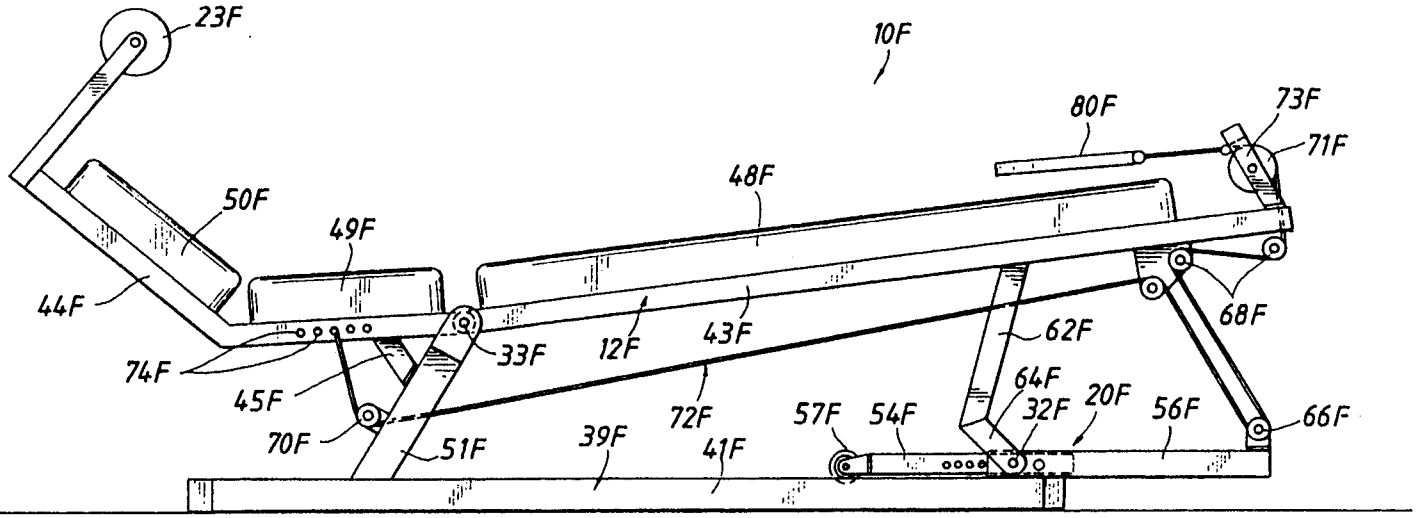
FIG. 13 is a side elevation of an additional embodiment of the exercise machine of this invention in which a lever adjacent an end of the platform has a roller on its lower end mounted on a rail of a supporting base for movement therealong upon raising of the platform by the user.
Figure 14:
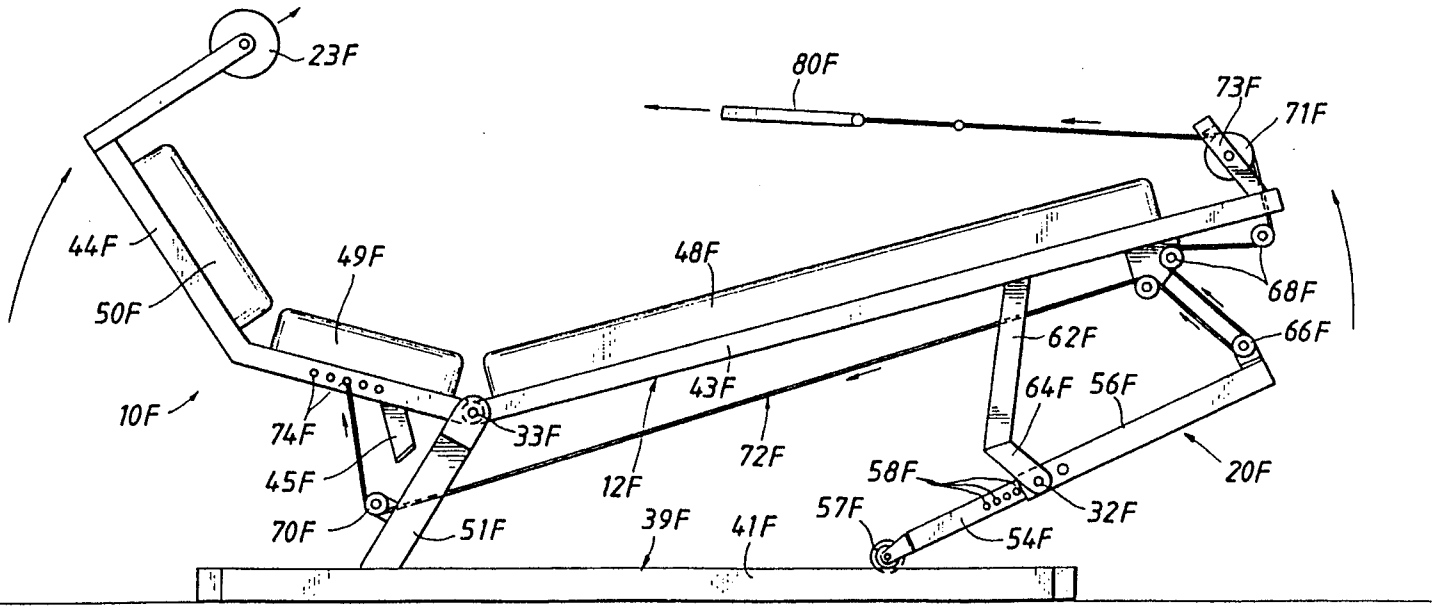
FIG. 14 is a side elevation of the exercise machine of FIG. 13 in which the lever is raised by the user from a manual pulling action and a thigh lifting action to lift the associated end of the platform with a roller on the end of the lever riding along the rail on the base.

Embodiment of FIGS. 13 and 14

FIGS. 13 and 14 show a further embodiment of the invention in which a supporting base is provided having a rail supporting an adjustable lever for back and forth movement thereon during actuation of the exercise apparatus. As illustrated, exercise apparatus 10F includes a platform 12F supported on a support base generally indicated at 39F on a supporting surface, such as the floor, and having a rail 41F. Platform 12F includes a main platform portion 43F having a pad 48F secured thereto and a rearwardly extending portion 44F having pads 49F and 50F secured thereon. A rear leg 51F secured to support base 29F is connected to platform 12F about pivot axis 33F. Rear platform portion 43F is mounted for pivotal movement about pivot 33F relative to main platform portion 43F. Support pads 48F, 49F, and 50F support the body of user 14F thereon in a supine position with pad 49F supporting the lower torso and pad 50F supporting the thighs of user 14F. A leg pad 23F is mounted above platform 12F for contact by the thighs 15F of user 14F.

A depending leg 45F is secured to rear platform portion 44F for limiting downward movement of platform portion 44F by contact with upstanding frame member 51F. Thus, upward pivotal movement of platform portion 44F provides a lifting action against the body of user 14F as shown in FIG. 14.

A lever 20F has inner and outer telescoping portions 54F and 56F which are longitudinally adjustable. A roller 57F is mounted on the end of inner lower telescoping portion 54F for rolling motion along rail 41F. A plurality of spaced openings 58F are provided in lower lever portion 54F and an adjustable pivot pin or rod 32F is mounted on the end of a downwardly extending leg 62F secured to platform 12F. Arm 62F has a lower crank portion 64F which includes pivot 32F on its lower end. A pulley 66F is secured to an extending end of upper lever portion 56F. Pulleys 68F are secured to platform 12F and a pulley 70F is secured to rear leg 51F. A pulley 71F is mounted on an arm 73F extending from an end of platform 12F. A cable indicated generally at 72F has one end anchored in a selected opening 74F of platform 12F. Cable 72F extends about pulleys 70F, 66F, 68F, 71F and has a hand strap 80F at its free end.

In operation, a user grips hand strap 80F and exerts a pulling force thereon while simultaneously exerting a lifting force from his thighs against pad 23F to tension cable 72F and raise lever 20F from pulley 66F with roller 57F on an end of lever portion 54F rolling a small distance along rail 41F on base 39F.

Increased resistance to the exercises resulting from the weight of user 14F may be selected by the user by increasing the distance between pivot 32F and roller 57F of lever 20F. The thigh action exerted against pad 23F and cable 72F is opposed to the pulling action exerted by hand strap 80F and cable 72F by user 14F, but both actions tension cable 72F to exert a lifting action on pulley 66F from cable 72F for raising the extending end of lever 20F and platform 12F as indicated in FIG. 14. Additionally, rear platform portion 44F is pivoted about pivot 33F. A user may exert a pulling action on hand strap 80F either separately or simultaneously with a lifting action by his thighs against roller pad 23F. Likewise, the lifting action exerted by his thighs against pad 23F may be provided separately, or omitted as desired.

Figure 15:
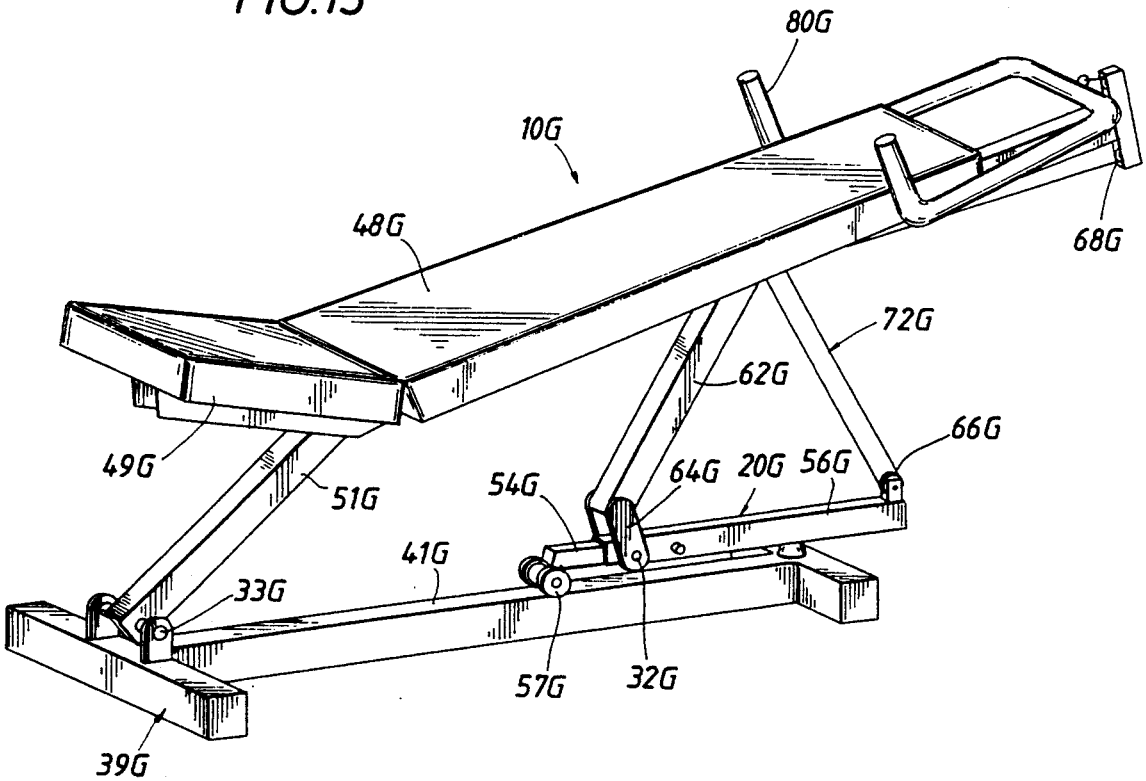
FIG. 15 is a perspective of a further embodiment of the invention in which the lever has a roller mounted on a supporting rail for movement therealong with the lever including a pair of telescoping portions.
Figure 16:
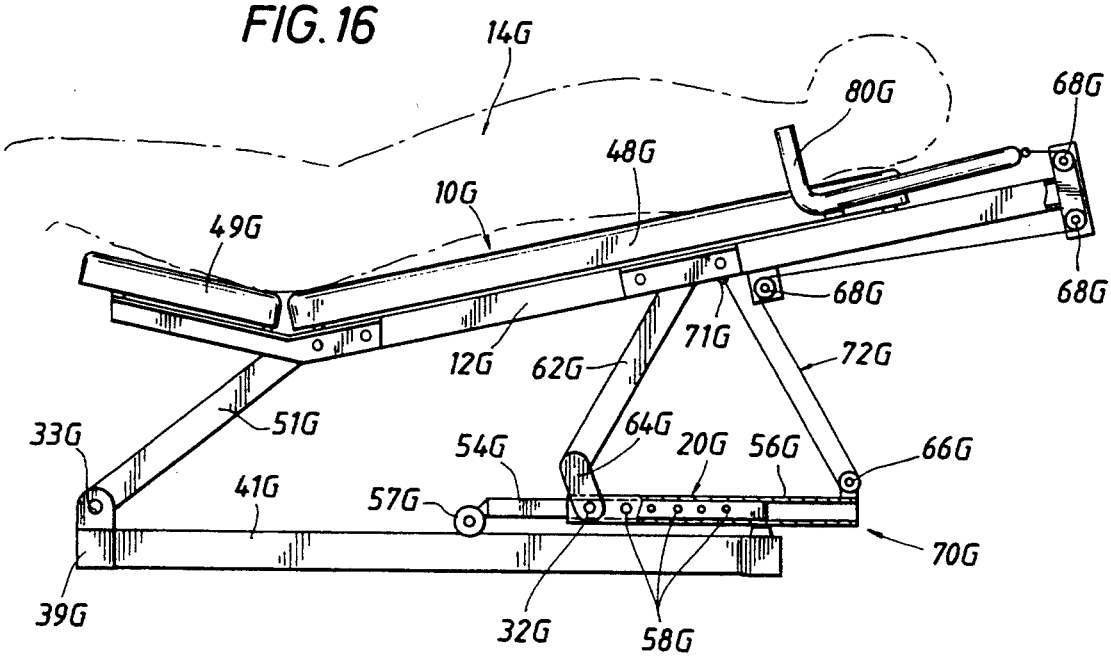
FIG. 16 is a side elevation of the exercise machine shown in FIG. 15.

Embodiment of FIGS. 15 and 16

Referring now to FIGS. 15 and 16, another exercise machine 10G is shown in which platform 12G includes pads 48G and 49G thereon. A base support 39G provides a rail 41G on which roller 57G of lower telescoping lever arm 54G is mounted for back and forth movement. Telescoping lever portions 54G and 56G of lever arm 20G are mounted for lengthwise adjustment relative to each other in the same manner as the embodiment of FIGS. 13 and 14. Arm 62G secured at its upper end to platform 12G has a crank arm 64G at its lower end pivotally connected at 32G to lever 20G. Crank arm 64G is rigidly secured to arm 62G. Upstanding rear leg 51G is secured to platform 12G adjacent one end thereof and is pivotally mounted at 33G adjacent its lower end to base support 39G. Pulley 66G is mounted on the extending end of lever portion 56G and pulleys 68G are mounted on platform 12G. A cable 72G is anchored at 71G to platform 12G and its free end is secured to handle bar 80G having a pair of hand grips thereon. Upon pulling on handle 80G by user 14G, cable 72G raises lever 20G by virtue of the force applied at pulley 66G with roller 57G rolling a small distance on rail 41G and platform 12G pivoting about pivot 33G during raising of lever 20G and platform 12G.

In operation, user 14G grips the hand grips on handle bar 80G and exerts a pulling action to tension cable 72G and lift pulley 66G to rotate lever 20G about pivot 32G with roller 57G rolling a small distance along rail 41G. Platform 12G is raised against the weight of user 14G upon raising of lever 20G and leg 51G pivots about pivot 33G upon raising of platform 12G. Selective resistance is achieved by varying the moment arm of lever 20G by varying the position of pin or rod 32G in holes 58G. By so doing, the torque required to lift the machine, exerted by the force via cable 72 acting at end 70G times the distance to roller 57G must be equal to or greater than the torque tending to maintain the machine at rest or at the bottom position. Such force is roughly equal to the weight of the user 14G times the distance of pin 32G to roller 57G. Accordingly, the smaller the ratio of the distance from pin 32G to roller 57G to the distance from end 70G to roller 57G, the easier it is for the user to pivot platform 12G about pivot 33G.

Figure 17:
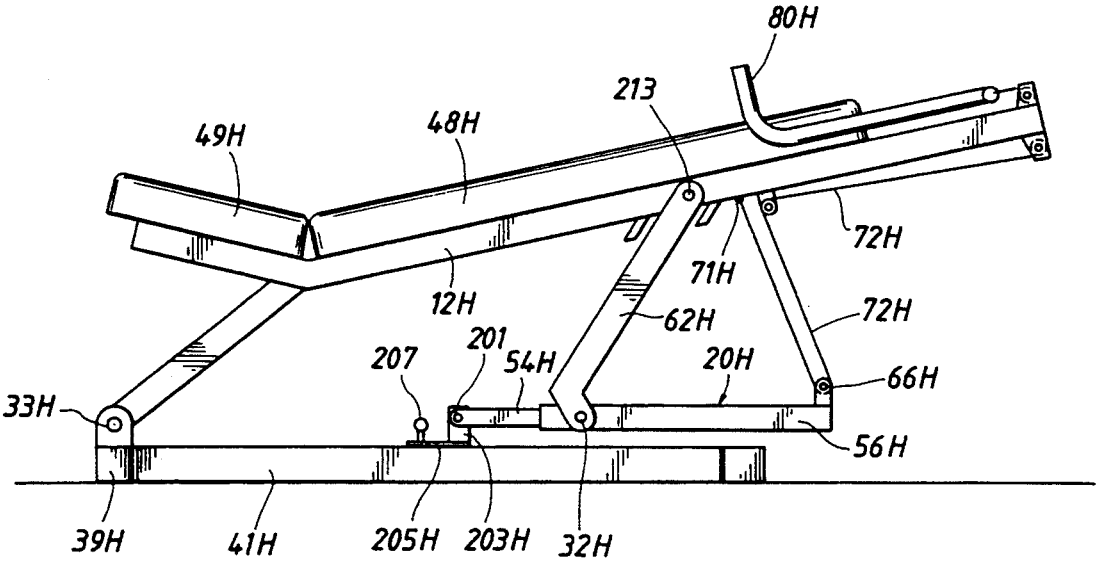
FIG. 17 is a side elevation of a further embodiment of the invention of which the machine of FIG. 16 is modified such that the lever is supported from a supporting rail by means of a pivot point which may be fixed to different points along such rail.

Embodiment of FIG. 17

The machine of FIGS. 15 and 16 may be modified as shown in FIG. 17. Rather than the selective positioning of crank 64G in holes 58G of FIG. 16, the machine 17 provides plate 205H with a spring loaded pull pin 207 mounted thereon such that the plate may be selectively fixed at different positions in holes along rail 41H. By so doing extension 54H telescopes within cylindrical arm 56H of lever 20H so as to shorten or lengthen the lever arm between pivot 201 of extension 54H and pulley 66.

In operation, when a user pulls on hand grips 80H, the cable 72H is tensioned tending to raise the platform 12H and the weight of the exerciser about pivot 201. Arm 62H pivots with respect to platform 12H at pivot 213 and with respect to lever 20H at pivot 32H.

Figure 18:
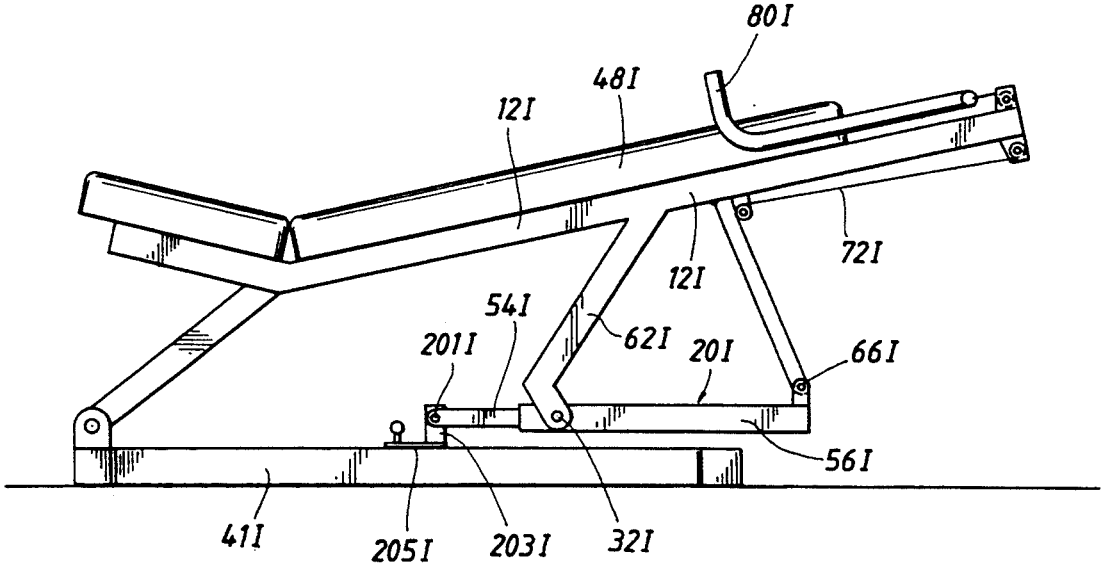
FIG. 18 is a side elevation of a further embodiment of the invention of which the machine of FIG. 16 is modified in a manner similar to that of FIG. 17 but with the elimination of one pivot for the connecting link between the rail and the lever arm.

Embodiment of FIG. 18

The machine of FIG. 18 is similar in all respects to the embodiment of FIG. 17, but arm 62I is pivoted to lever arm 20I at pivot 32I and is not pivoted with respect to platform 12I.

In operation, when a user pulls on hand grips 80I, the cable 72I is tensioned tending to raise the platform 12I and the weight of the exerciser about pivot 20I. Arm 62I pivots with respect to lever arm 20I at pivot 32I. As platform 12I is raised and lowered, extension 54I reciprocates within cylindrical lever portion 56I.

While several embodiments of the present invention have been illustrated in detail, it is apparent that modifications and adaptations of the embodiments shown will occur to those skilled in the art. However, it is to be expressly understood that such modifications and adaptations are within the spirit and scope of the present invention as set forth in the following claims.

What is claimed is:

1. An exercise machine adapted for placement on a supporting surface and adapted for using the body weight of the user as a resistance to exercise which may be selectively varied, said exercise machine comprising:

an elongate platform;

lever means including a lever pivotally connected to a pivot axis of said platform for lifting a first end of said platform against the body weight of the user;

pivot means disposed at the second end of the platform for supporting the second end of the platform with respect to a supporting surface as said first end pivots about said second end of said platform with said pivot means remaining in a substantially fixed position with respect to said supporting surface during pivoting of said platform about said second end while said first end of said platform is lifted and lowered during exercising by the user;

a roller carried by said lever for supporting and producing rolling movement of said first end of said platform with respect to said supporting surface whereby said roller allows said first end of said platform to roll along said supporting surface as said platform pivots about said second end of said platform;

means on said lever to adjust selectively the pivot axis and leverage force required for pivoting of said lever against the weight of a user on the platform; and actuating means which may be actuated by the user on the platform for pivoting of said lever about said pivot axis and lifting of said first end of said platform against the resistance provided by the body weight of the user.

2. An exercise machine as set forth in claim 1 wherein said lever is elongate and extends along a straight longitudinal axis; and said means on said lever to adjust selectively the leverage force comprises a plurality of openings spaced longitudinally along said lever with a selected opening providing said pivot axis.

3. An exercise machine as set forth in claim 2 wherein said lever has an upper end portion extending above said platform adapted to be actuated by the user for pivoting of said lever.

4. An exercise machine as set forth by claim 3 wherein said actuating means comprises a pair of hand grips on said upper end portion of said lever for manually pulling said lever in a direction toward the platform for raising said platform.

5. An exercise apparatus as set forth in claim 3 wherein said actuating means comprises a leg pad mounted on said upper end portion of said lever adapted to be contacted by the thighs of the user for lifting said leg pad and pivoting said lever for raising said platform.

6. An exercise machine as set forth in claim 1 further comprising a seat mounted on said platform to support the lower torso of the user in a reclining position on the platform, and means for mounting one end of said seat for pivotal movement relative to said platform upon raising of said platform thereby to exercise pelvic muscles of the user.

7. An exercise machine as set forth in claim 6 wherein said seat has rollers on the other end thereof, said rollers being supported by said lever and rolling along said lever upon raising of said platform thereby to pivot said seat relative to said platform.

8. An exercise machine as set forth in claim 1 wherein said lever means has a portion thereof offset laterally from the pivot axis of said lever on said platform, and said actuating means has an end pivotally connected to said laterally offset portion of said lever for pivoting of said lever.

9. An exercise machine as set forth in claim 8 wherein a plurality of pivot axes are provided on said laterally offset portion of said lever with said actuating means engaging a selected pivot axis.

10. An exercise machine as set forth in claim 9 wherein said actuating means comprises a cable having one end engaging a selected pivot axis and the other free end adapted to be pulled by a user for pivoting of said lever and raising of said platform.

11. The exercise machine of claim 1 wherein said anti-friction means is reciprocatingly moveable with respect to said supporting surface during exercising by the user.

12. An exercise machine for supporting a user in a reclining position thereon and using the body weight of the user as a resistance to exercise which may be selectively varied, said exercise machine comprising:

an elongate platform on which the user may be supported in a reclining position;

lever means including a lever pivotally connected a pivot axis of said platform for lifting a first end of said platform against the body weight of the user;

pivot means disposed at the second end of the platform for supporting the second end of the platform as said first end pivots about said second end of said platform;

anti-friction means carried by said lever for supporting said first end of said platform;

means on said lever to adjust selectively the pivot axis and leverage force required for pivoting of said lever against the weight of a user on the platform;

means which may be actuated by the user on the platform for pivoting of said lever about said anti-friction means and lifting of said first end of said platform against the resistance provided by the body weight of the user; and a support base for said platform for supporting said anti-friction means whereby said anti-friction means carried by said lever means may move back and forth on said support base upon actuation of said exercise machine.

13. An exercise machine as set forth in claim 12 wherein said lever means comprises inner and outer telescoping portions adjustably connected to each other to vary selectively the leverage of said lever.

14. An exercise machine as set forth in claim 13 wherein said outer telescoping portion of said lever means is pivotally connected to said platform adjacent a lower end, and said actuating means engages the upper end of said outer telescoping portion for pivoting of said lever.

15. An exercise machine as set forth in claim 14 wherein said anti-friction means is a roller on said lower end of said inner telescoping portion, said roller adapted to roll along said support base upon pivoting of said lever means.

16. An exercise machine as set forth in claim 14 wherein a pulley is mounted on the upper end of said outer telescoping portion, and said actuating means comprises a cable extending about said pulley and pulled by the user to raise the lever and platform.

17. An exercise machine for supporting a user in a reclining position thereon and using the body weight of the user as a resistance to exercise which may be selectively varied, said exercise machine comprising;

an elongate platform on which the user may be supported in a reclining position;

lever means including a lever pivotally connected to a pivot axis of said platform for lifting a first end of said platform against the body weight of the user;

pivot means disposed at the second end of the platform for supporting the second end of the platform as said first end pivots about said second end of said platform;

anti-friction means carried by said lever for supporting said first end of said platform;

means on said lever to adjust selectively the pivot axis and leverage force required for pivoting of said lever against the weight of a user on the platform;

means which may be actuated by the user on the platform for pivoting of said lever about said anti-friction means and lifting of said first end of said platform against the resistance provided by the body weight of the user; and a support base for said platform for supporting said anti-friction means whereby said anti-friction means carried by of said lever means may pivot with respect to said support base upon actuation of said exercise machine.

18. The exercise machine of claim 17 wherein said lever means comprises inner and outer telescoping portions, and said anti-friction means and said means to selectively adjust the pivot axis includes a plate which may be selectively placed at different positions along said support base, a pivot secured to said plate, and a connection of said inner portion of said lever means to said pivot wherein as said outer telescoping portion of said lever means is raised and lowered, said inner portion pivots about said pivot of said plate and reciprocates within said outer portion.

19. An exercise machine to permit a user to perform an exercise from a supine position comprising:

a platform to support the user in supine position and including a seat to support the lower torso of the user;

a lower base frame supported on a floor or the like;

a rear leg extending between said platform and said lower base frame and connected to said platform generally beneath said seat adjacent a rear end of said platform;

a front lever between said platform and said lower base frame adjacent the front end of said platform and having a lower end supported on said base frame for back and forth movement along said base frame, said front lever being pivotally connected intermediate its length to said platform;

pivot means disposed at the rear of the platform for supporting the rear of the platform with respect to said lower base frame as said front end pivots about said rear end of said platform; and actuating means on said platform operatively connected to an upper end of said lever adapted to be actuated by the user for raising of the upper end of said front lever and movement of said lower end along said base frame to pivot the first end of said platform about said pivot means while being resisted by the weight of the user thereon.

20. The exercise machine as set forth in claim 19 wherein a roller is mounted on the lower end of said front lever for riding along said base frame.

21. The exercise machine as set forth in claim 19 wherein said front lever includes a pair of telescoping portions adjustably connected to each other to vary the length of said front lever.

22. The exercise machine as set forth in claim 19 wherein said actuating means includes a cable and a pulley adjacent the outer end of said lever engaged by the cable for lifting of said lever upon tensioning of said cable by said user.

23. The exercise machine as set forth in claim 22 wherein said actuating means includes a manual gripping element connected to said cable for pulling of said cable by the user.

24. The exercise machine as set forth in claim 22 wherein said actuating means includes an upper roller pad for engagement by the thighs of the user, said upper support pad being operatively connected to said cable for tensioning of said cable and lifting of said lever upon upward movement of said roller pad from a force exerted by the thighs of the user.

25. The exercise machine as set forth in claim 22 including a rear platform means mounted for relative pivotal movement with respect to said lower base frame, said rear portion having said upper roller pad secured thereon and connected to said cable for tensioning said cable upon an upward pivotal movement of said rear platform means.

* * * * *